US005673751A

United States Patent [19]

Head et al.

[11] Patent Number: 5,673,751

[45] **Date of Patent: *Oct. 7, 1997**

[54] SYSTEM FOR CONTROLLING THE FLOW OF FLUID IN AN OIL WELL

[75] Inventors: Philip Head, London; Paul Gullett, Woolsthorpe-by-Colsterworth; Paul Wilmott, London, all of United Kingdom

[73] Assignee: Stirling Design International Limited, United Kingdom

[ * ] Notice: The term of this patent shall not extend beyond the expiration date of Pat. No. 5,404,945.

[21] Appl. No.: 418,529

[22] Filed: Apr. 7, 1995

Related U.S. Application Data

[63] Continuation of Ser. No. 996,923, Dec. 29, 1992, Pat. No. 5,404,945.

[30] Foreign Application Priority Data

Dec. 31, 1991 [GB] United Kingdom ..... 9127535

[51] Int. Cl.[6] ..... E21B 17/14; E21B 34/06

[52] U.S. Cl. ..... 166/155; 137/599; 138/42; 166/242.1; 166/318; 166/320

[58] Field of Search ..... 166/316, 320, 166/153, 154, 155, 242.1, 242.8, 318, 285, 332.1, 332.4; 138/42, 43; 251/127; 137/599

[56] References Cited

U.S. PATENT DOCUMENTS

| | | | |
|---|---|---|---|
| Re. 20,529 | 10/1937 | Penick et al. | 166/75.14 X |
| 1,915,867 | 6/1933 | Penick | 138/42 |
| 2,350,867 | 6/1944 | Bean et al. | 166/75.14 X |
| 3,586,104 | 6/1971 | Hyde | 166/142 |
| 4,058,163 | 11/1977 | Yandell | 166/177 |
| 4,466,462 | 8/1984 | Morris | 138/42 |
| 5,062,481 | 11/1991 | Gullett | 166/153 |

FOREIGN PATENT DOCUMENTS

| | | |
|---|---|---|
| 0421763A1 | 4/1991 | European Pat. Off. . |
| 2109035 | 5/1972 | France . |
| 724806 | 3/1980 | U.S.S.R. . |
| 891890 | 4/1980 | U.S.S.R. . |
| 2147641A | 5/1985 | United Kingdom . |
| WO9004699 | 5/1990 | WIPO . |

*Primary Examiner*—Hoang C. Dang

*Attorney, Agent, or Firm*—Akin, Gump, Strauss, Hauer & Feld, L.L.P.

[57] ABSTRACT

A device is provided for controlling fluid flow in oil well casings or drill pipes. The device defines a flowpath for fluid through a casing section or drill pipe with the flowpath including a throttling valve which restricts or prevents the flow of fluid therethrough. This can be used to prevent U-tubing in casings or can be used to locate leaks in drill pipes or can be used to monitor the position of successive fluids of differing viscosities in a casing string.

10 Claims, 10 Drawing Sheets

SYSTEM FOR CONTROLLING THE FLOW OF FLUID IN AN OIL WELL

This is a continuation of application Ser. No. 07/996,923 filed on Dec. 29, 1992 now the U.S. Pat. No. 5,404,945.

BACKGROUND TO THE INVENTION

The invention relates to the control of fluid flow in oil wells.

An oil well is drilled using a drill attached to drill pipes and, after drilling, casings of successively decreasing diameters are inserted into the drilled hole, with the final casing, the production casing, conveying the oil from the well to the well head.

Various fluids are pumped down both the drill pipes and the casing string—collectively referred to as "tubing" or "tubes"—and there is a need to control the flow of such fluids. For example, the succession of casings are cemented in position to, for example, prevent drilling fluid from circulating outside the casing and causing erosion. Cementing is also necessary in the casings close to the surface to seal off and protect fresh water formations, provide a mounting for blow-out preventer equipment and for supporting the inner casings.

Cementing is achieved by preparing a cement slurry and then pumping it down the casing. As it is pumped down, the cement slurry displaces the mud already in the casing and passes out of the end of the casing and then up the exterior of the casing, displacing the mud in front of it. When all the mud has been displaced and the cement slurry is therefore continuous around the outside of the casing, pumping stops and the cement is allowed to set. The end of the casing includes a one-way valve which, when cementing is complete, prevents the cement passing back up the casing.

The cement slurry has a density which is greater than the density of the mud which it displaces. This can result in the phenomenon of "U tubing" in which the forces resisting the flow of cement are insufficient to allow the pumping pressure to be maintained and the cement slurry falls in the casing under the effect of gravity faster than the pumping rate. Accordingly, when 'U' tubing occurs, the cement slurry is no longer under the control of the pump.

This is undesirable because the increased flow rates in 'U' tubing can cause a strongly turbulent flow which can erode seriously any weak formations around the casing and cause laminar flow, an undesirable flow regime while equilibrium is being sought. Further, it can result in a vacuum being formed behind the 'U' tubing cement slurry and the slurry may then halt while the pump slurry fills the vacuum. It can also cause surging in the rate at which the mud is forced to the surface and this can be difficult to control at surface without causing unfavourable pressure increases downhole.

In addition, during drilling of the oil well, drilling mud is pumped down the drill pipe to remove drilled material to the surface. If the drill pipe develops a leak, the volume of fluid at the drill bit is reduced and this can have adverse consequences. The drilling mud may eventually break the drill pipe at the leak. It is therefore necessary, when this occurs, to remove the whole drill pipe and examine each section in turn. This examination can be very time consuming in a drill pipe which is many thousands of meters in length.

It can also be necessary to pump successively through the drill pipe two or more fluids of differing viscosities. It can be useful to know the position along the drill pipe of the "front" between successive fluids.

SUMMARY OF THE INVENTION

According to a first aspect of the invention, there is provided a device for controlling the flow of fluid in oil well tubing, the device defining a flow path for fluid through the tubing, the flow path including a throttling valve which restricts or prevents the flow of fluid therethrough.

The throttling valve can be arranged so that the fluid can flow through the device at normal pumping pressures but when the pressure rises as a result of the onset of U-tubing, the throttling effect of the valve prevents U-tubing.

Preferably the device includes a by-pass passage through which fluid may flow without passing through said throttling valve the by-pass passage being selectively blockable to divert fluid through said throttling valve.

With this embodiment and according to a second aspect of the invention there is provided the use of a device according to the first aspect of the invention comprising inserting the device in a drill pipe adjacent to, but upstream of, a bottom hole assembly carried by the drill pipe, pumping a first fluid of a first viscosity at a first ratio of pumping pressure to flow rate through the casing string, the by-pass passage and the bottom hole assembly, observing a reduction in said ratio arising from a leak in said casing string, closing said by-pass passage, pumping down the casing string a known volume of a second fluid having a greater viscosity than the first fluid, observing the pressure of the second fluid during said pumping, noting when said pressure increases and determining the location of said leak from the volume of fluid of greater viscosity pumped down said casing string at the time said pressure increases.

Also with this embodiment and according to a third aspect of the invention, there is provided the use of a device according to a first aspect of the invention comprising inserting the device in a casing string adjacent to, but upstream of, the end of the casing string, closing the by-pass passage of said device, pumping through the casing string successively at least two fluids of differing viscosities and observing the change in pumping pressure with time during said pumping to determine when successive fluids reach the device.

The following is a more detailed description of some embodiments of the invention, by way of example, reference being made to the accompanying drawings in which:

DESCRIPTION OF THE PREFERRED EMBODIMENTS

Figure 1:
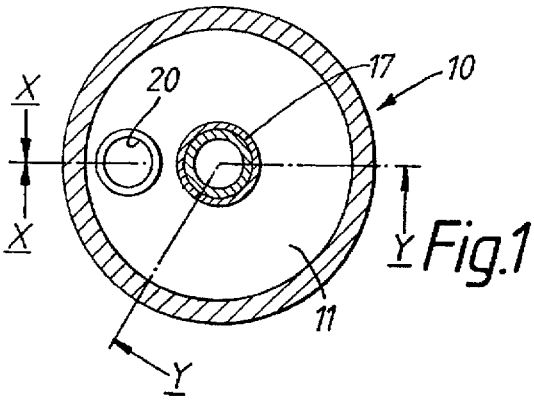
FIG. 1 is a cross-section of an oil well casing showing the view from above of a first device for preventing U-tubing in the flow of cement slurry in the casing.
Figure 2:
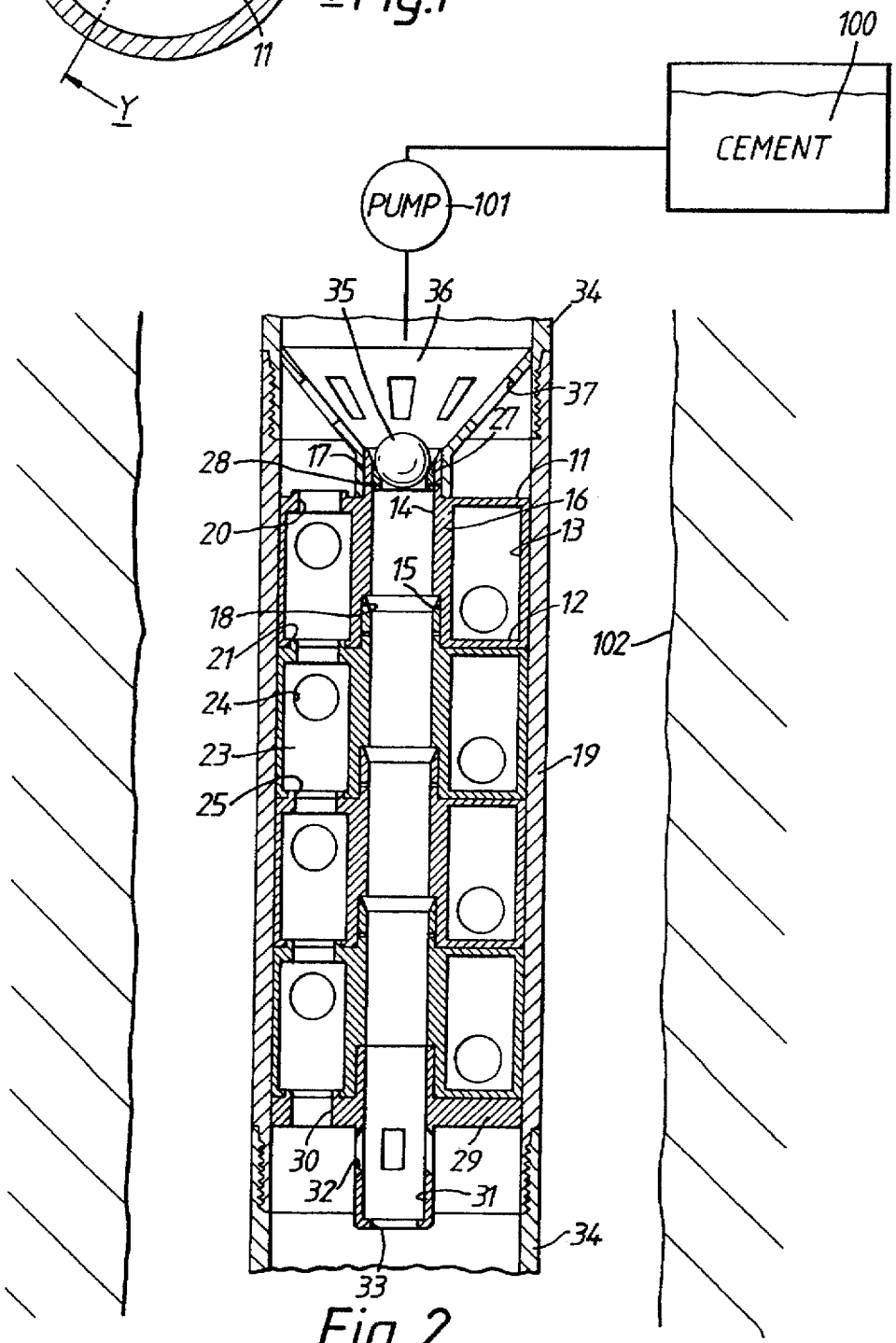
FIG. 2 is a section on the line Y—Y of FIG. 1 showing the device with a central by-pass passage blocked.
Figure 3:
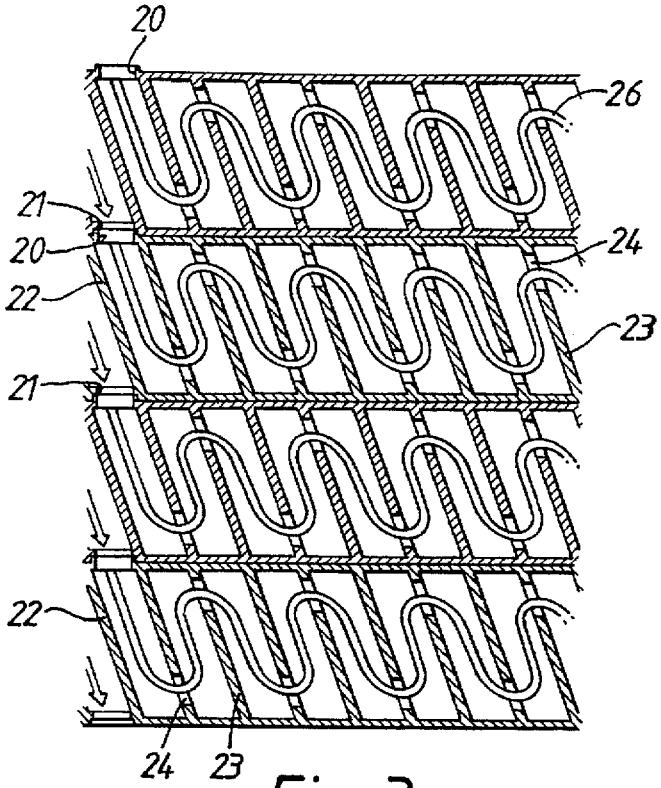
FIG. 3 is a section on the line X—X of FIG. 1 showing the interior construction of a number of members forming the device.

Referring first to FIGS. 1 to 4, the first device is formed by a stack of members 10 which are generally identical. As best seen in FIGS. 1 and 2, each member comprises an upstream end plate 11 and a downstream end plate 12 separated by an annular outer wall 13. The end plates 11,12 are provided with central apertures 14,15, respectively which are inter-connected by a tube 16. As best seen in FIG. 2, the tube is provided with a projecting portion 17 extending beyond the upstream plate and having an exterior diameter which is less than the exterior diameter of the remainder of the tube. The interior of each tube 16 adjacent the downstream plate 12 is provided with an increased diameter interior portion 18. This allows the projecting portion 17 of the downstream member to be inserted in the interior portion 18 of the adjacent upstream member to connect the two members together in the stack. In the embodiment shown in the drawings, four such members 10 are interconnected in this way.

As also seen in FIG. 2, the exterior diameters of the outer walls 13 are such that the stack is a close fit in the interior of an associated casing section 19. Alternatively the stack may be connected to the section by, for example, bonding or gluing.

Each upstream plate 11 is provided with an inlet aperture 20 and each downstream plate 12 is provided with an outlet aperture 21 axially aligned with the associated inlet aperture 20. An unapertured plate 22 (see FIG. 3) extends between the end plates 11,12 and between the outer wall 13 and the tube 16, and lies in a plane angled to a plane including the axis of the tube 16, to prevent direct communication between the inlet aperture 20 and the outlet aperture 21.

A plurality of similarly inclined plates 23 are spaced equi-angularly around each member 10. Each of these plates, however, is provided with an orifice 24 with the orifices 24 being alternately adjacent the downstream plate 12 and the upstream plate 11.

As seen in FIG. 2, each inlet aperture 20 is provided with a flange 25 which is received in the outlet aperture 21 of the preceding upstream member, to interconnect the inlet and outlet apertures 20,21.

There is thus formed between the inlet aperture 20 of the most upstream of the members 10 and the outlet aperture 21 of the most downstream of the members 10 a fluid flow passage through successive orifices 24 in the four members 10. This is indicated by the serpentine line 26 in FIG. 3. The cross-section of the passage in the chambers between adjacent orifice plates 23 is much greater than the cross-section of the associated orifices 24.

The function of these orifices 24 will be described below.

The most upstream of the members 10 carries a seat 27 in the associated projecting portion 17. The seat 27 is connected to the projecting portion 17 by shear pins 28, whose function will be described below. An upwardly opening frusto conical cup 36 surrounds the seat 27 and is provided with a number of holes 37 to allow the passage of fluid past the cup 36.

The stack of members 10 rests on a catcher sub 29 provided at the downstream end of the casing section 19. The catcher sub has an outlet 30 connected to the outlet aperture 21 of the most downstream of the members 10 and also has a central tube 31 connected to the tube 16 of the members 10. The lowermost portion of this tube 31 is provided with radial holes 32 and an axial hole 33. The function of these will also be described below.

The U-tubing device described above with reference to FIGS. 1 to 4 is used in the following way.

Figure 4:
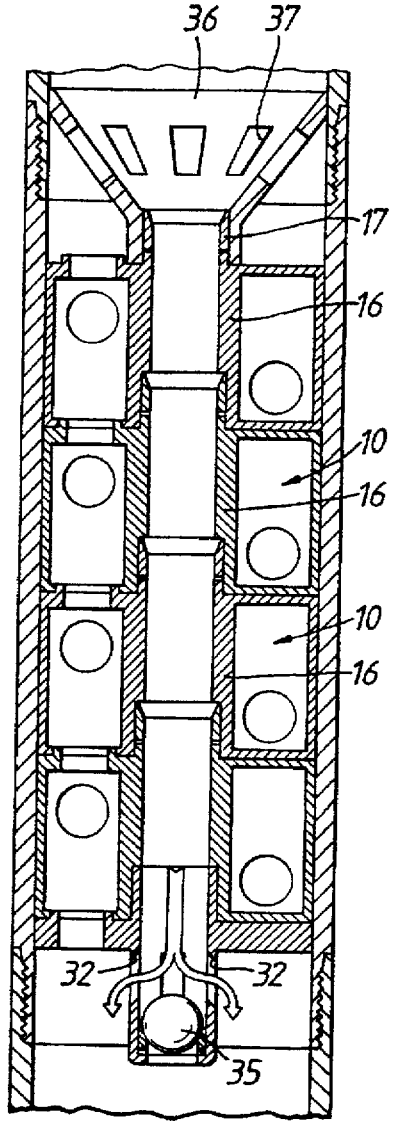
FIG. 4 is a similar view to FIG. 2 but showing the by-pass passage opened to allow cement slurry to by-pass the device.

The casing section 19 is incorporated in a casing string (of which two sections 34 are shown in FIGS. 2 and 4), with the device being towards the lower end of the string. The ball 35 is omitted. When cementing is to take place, a drilling mud is first passed through the casing string to condition the well with the mud passing primarily through the tubes 16 but also passing through the members 10. Next, the ball 35 is dropped into the casing string and is guided by the cup 36 to rest on the seat 27, so closing the tubes 16. A cement slurry from a tank 100 is then mixed at the well head. A cementing head is fixed to the casing and cement slurry is pumped via a pump 101 into the casing string. The cement slurry displaces the drilling mud in front of it, with the passage of the mud through the device creating a limited back pressure proportional to the flow rate which is overcome by the pumping pressure of the cement slurry, but which, nevertheless, does have some tendency to restrict the onset of U-tubing before the cement slurry reaches the device.

When the cement slurry reaches the device, the presence of the ball 35 in the projecting portion 17 of the most upstream of the members 10 prevents the cement slurry entering the by-pass passage formed by the tubes 16. Instead, the cement slurry enters the inlet aperture 20 of the most upstream of the members 10 and passes through the passage defined by the members 10 before exiting through the outlet aperture 21 of the most downstream of the members 10 and then through the outlet 30 in the catcher sub 29 from which it passes down the remainder of the casing string, and up around the casing string until the annular gap between the casing string and the hole 102 is filled with cement. The volume of cement pumped down the well is calculated exactly to fill this space.

While the flow of cement slurry is under the control of the well head pump, the pressure and velocity of the cement slurry are such that they pass easily through the orifices 24 in the plates 23. If, however, the cement slurry starts to move more quickly than the pumping rate (a phenomenon which will cause U-tubing if unchecked), such movement is accompanied by a sudden pressure increase. Under these circumstances, the orifices 24 act as a throttling valve and the number of orifices 24 and their dimensions are chosen such that, as the cement slurry approaches pressures which are liable to cause U-tubing, increased flow of cement slurry through the orifices 24 is prevented. The pressure surge is thus prevented from passing the device and from passing through the casing string and up between the casing string and the bore. In this way, U-tubing is prevented. In certain cases, the pressure rise may be so rapid that the throttling effect is such that flow through the device ceases such that the throttling valve prevents the flow of fluid therethrough.

It will be appreciated that the number of members, the dimensions of the orifices and the number of orifices will be chosen to match the viscosity and pressures of the fluid being controlled. In fact, the most easily varied parameter is the number of members 10 and this can be increased and decreased as required.

Although the passage through the members 20 is designed to pass all particulate matter within the cement slurry, it is possible for the device to become plugged. If this occurs, the cement pressure increases rapidly and at a particular critical pressure associated with plugging, the frangible ring 28 shears allowing the ball 35 to drop through the passage formed by the tube 16 until the ball 35 is received by the catcher sub 29. The cement slurry then passes through the tube 16 and emerges through the holes 32 in the catcher sub 29, so by-passing the plugged device. This is a safety feature.

Figure 7:
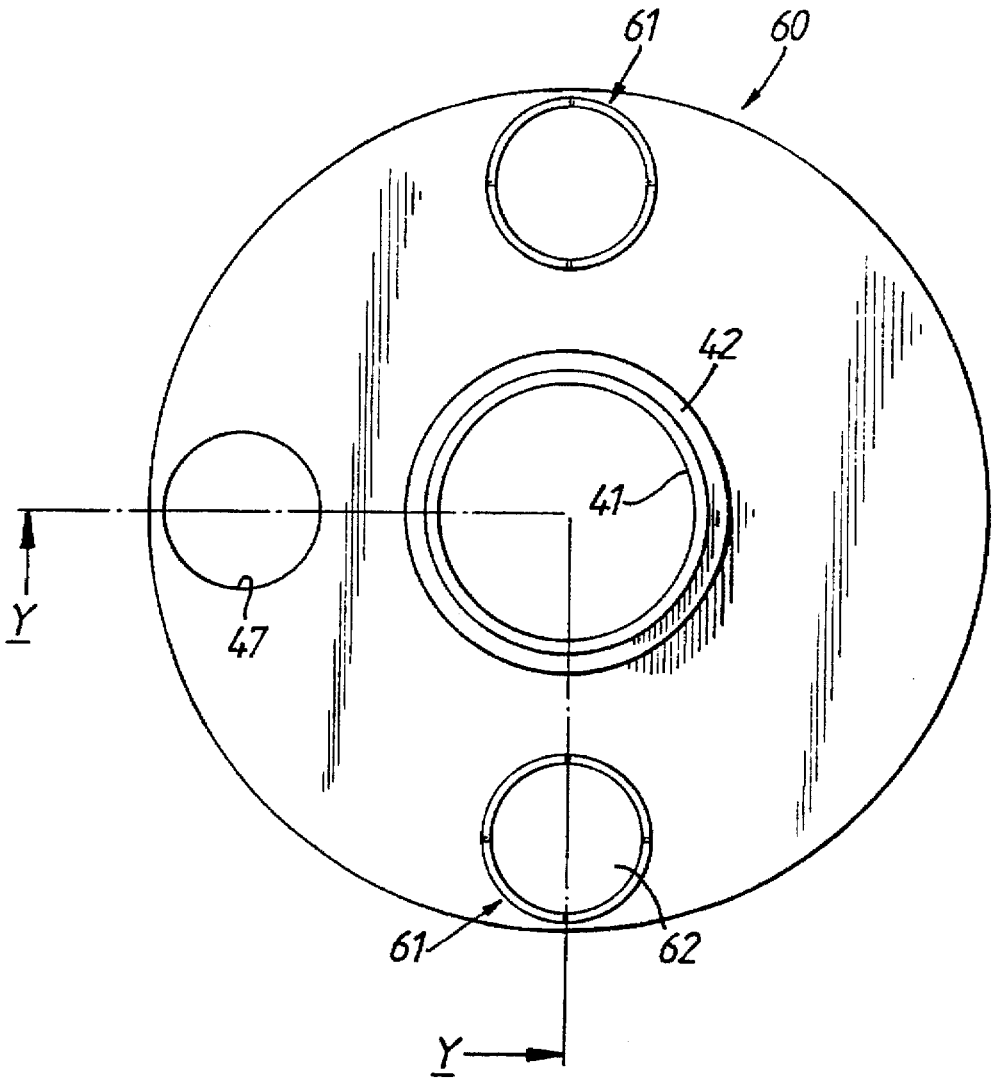
FIG. 7 is a plan view from above of a second form of member which, when arranged in a stack, forms a third device for preventing U-tubing in the flow of drilling mud/cement slurry in oil well casings.
Figure 8:
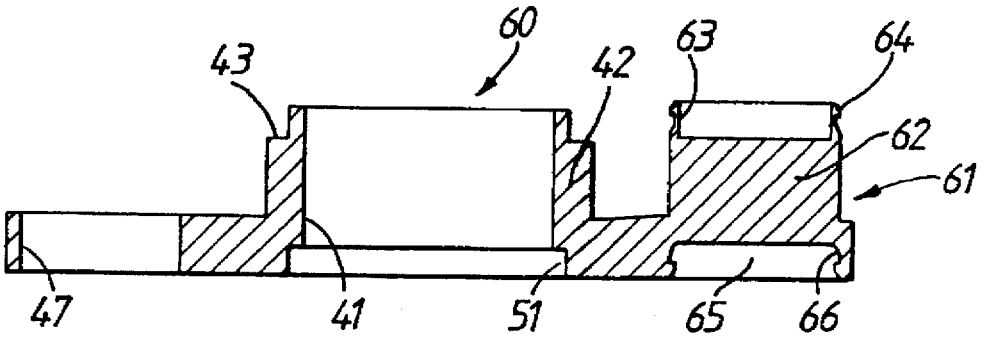
FIG. 8 is a section on the line Y—Y of FIG. 7.
Figure 9:
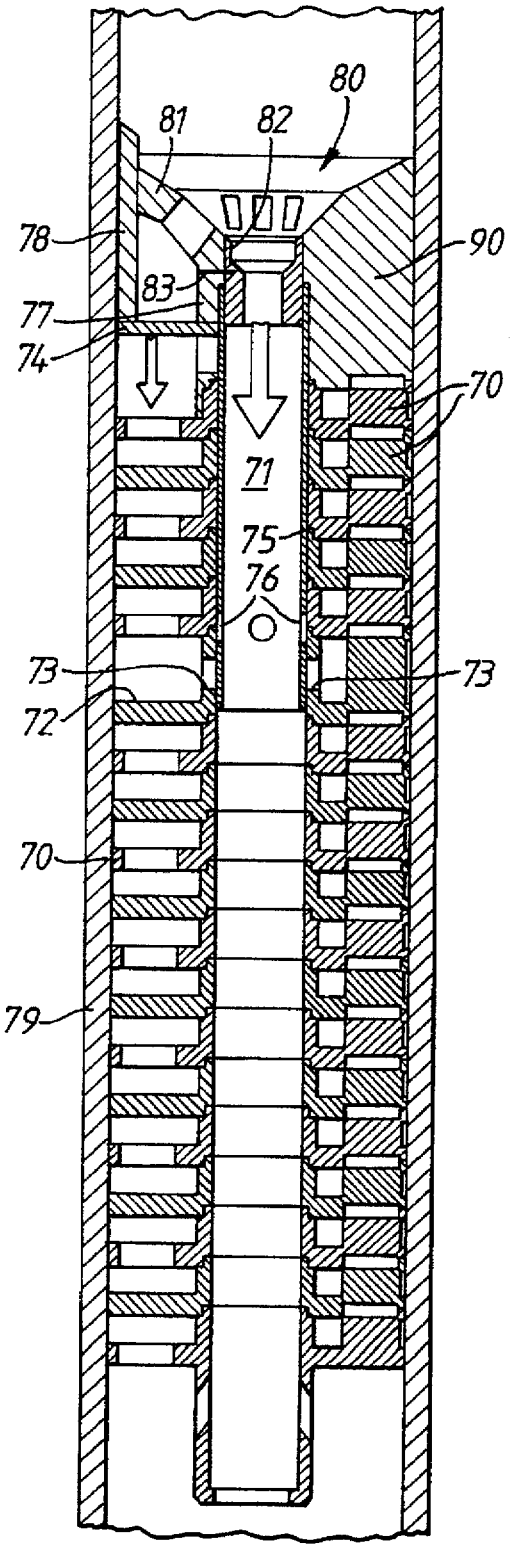
FIG. 9 is a section through a device preventing U-tubing in the flow of fluid in oil well casings formed by a stack of members either as shown in FIGS. 5 and 6 or as shown in FIGS. 7 and 8, the section being taken on the line Y—Y of FIGS. 5 or 7, and the device being provided with an upstream end element.
Figure 10:
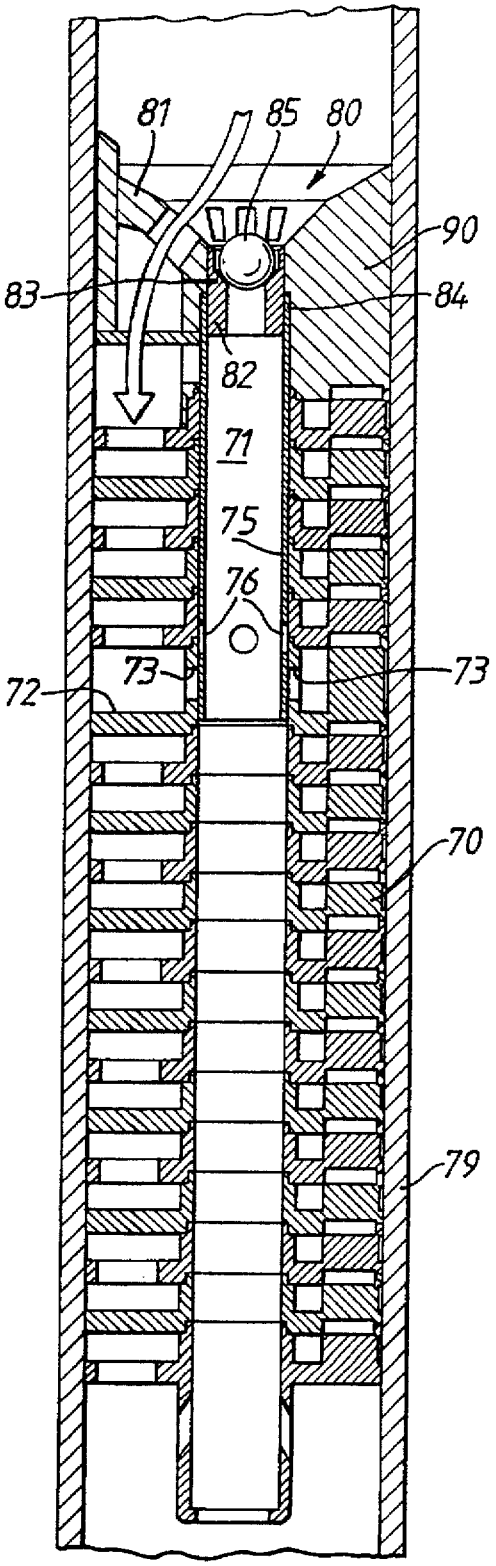
FIG. 10 is a similar view to FIG. 9 but showing a ball blocking a by-pass passage of the device.
Figure 11:
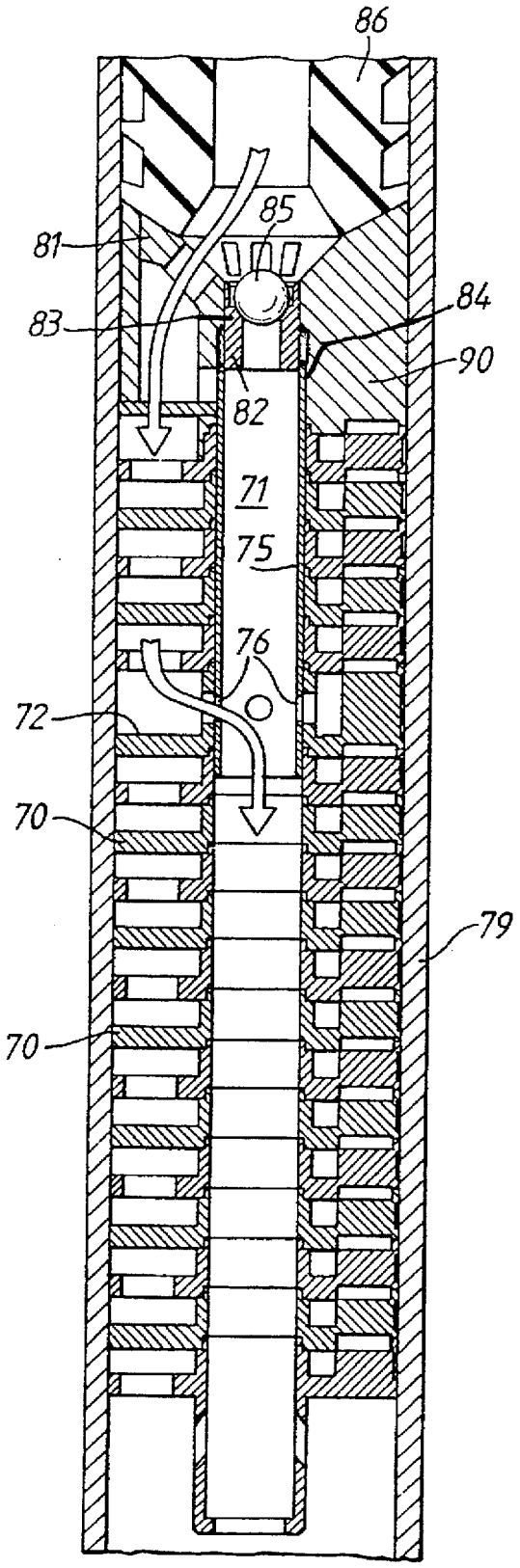
FIG. 11 is a similar view to FIGS. 9 and 10 but showing a valve operated so that fluid passes through only part of the device before entering a central by-pass passage.
Figure 12:
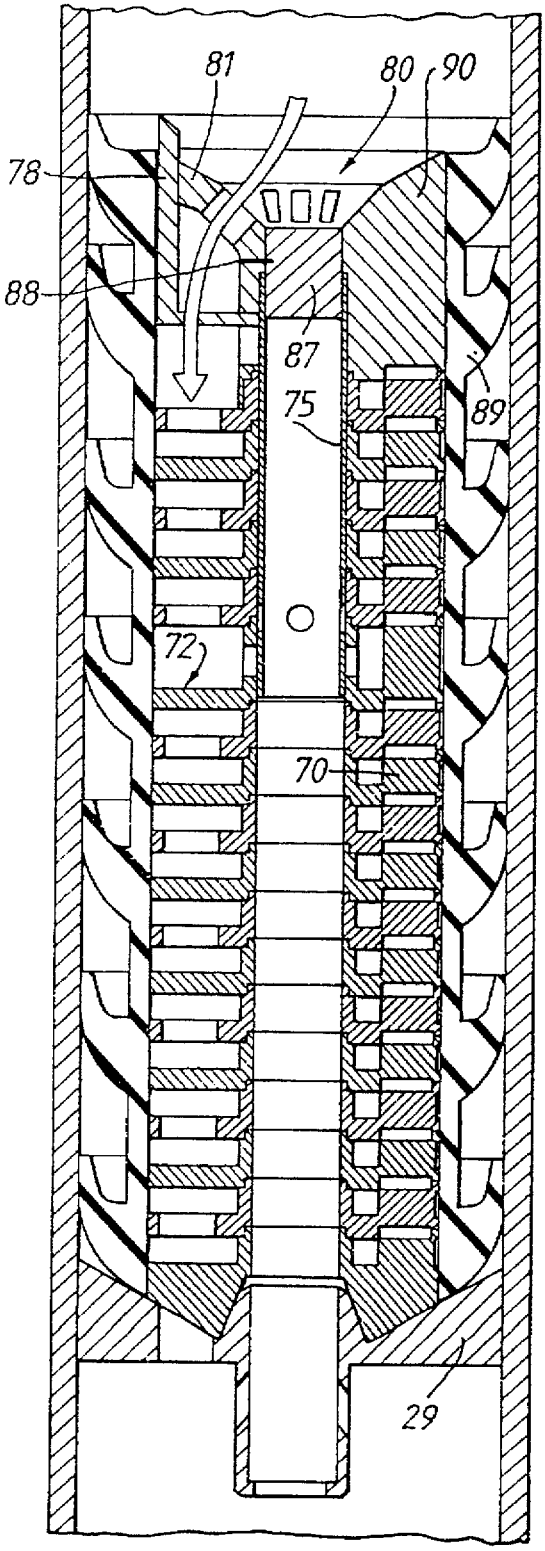
FIG. 12 is a similar view to FIG. 11, but showing a fourth form of device composed of elements as shown in either FIG. 5 and 6 or FIGS. 7 and 8 with the stack of members being surrounded by a wiper plug.
Figure 13:
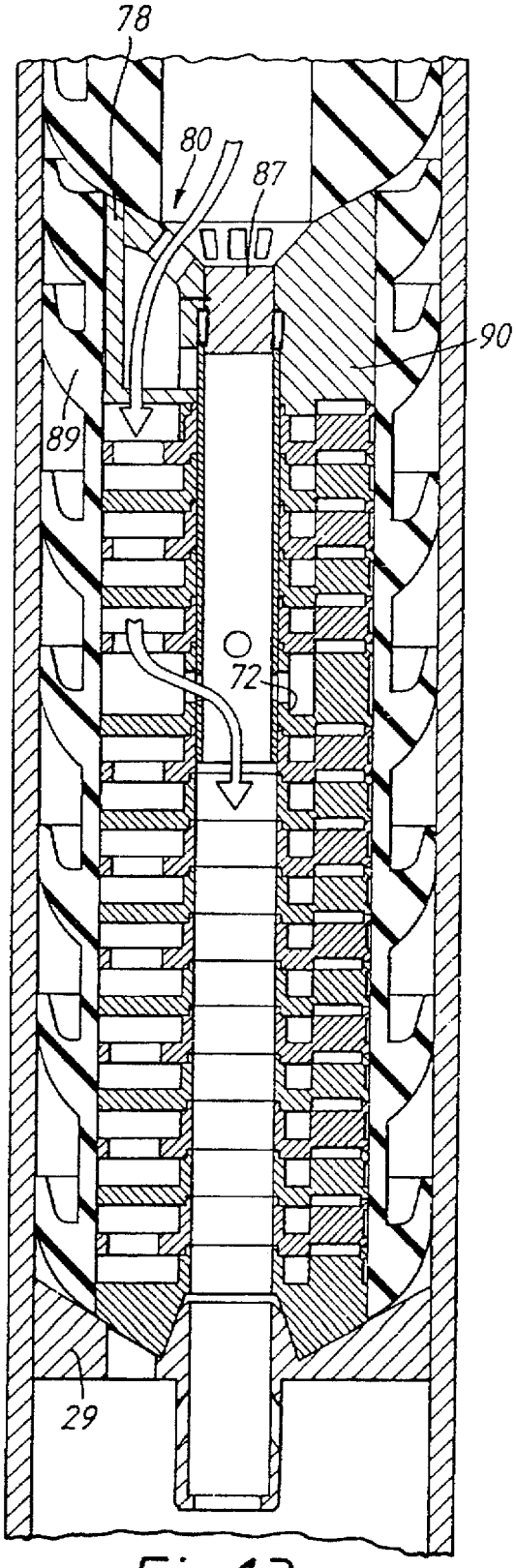
FIG. 13 is a similar view to FIG. 12 but showing the upper end of the third device engaged by a second wiper plug to open a valve so that cement slurry passes through only a proportion of the device.
Figure 14:
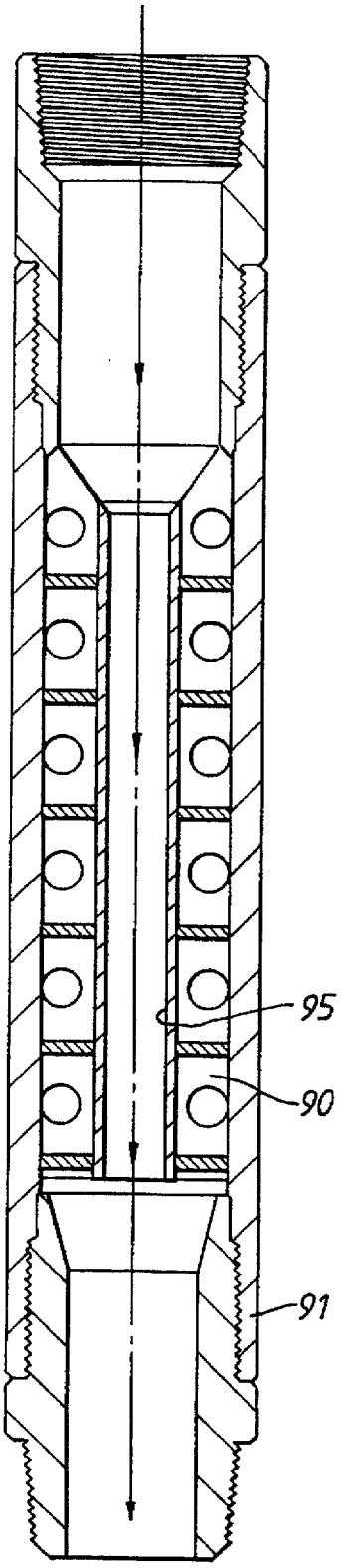
FIG. 14 is a similar view to FIGS. 1 to 4 but omitting an outlet tube to the by-pass passage of the device and for use in locating a washed-out connection in a drill pipe.
Figure 15:
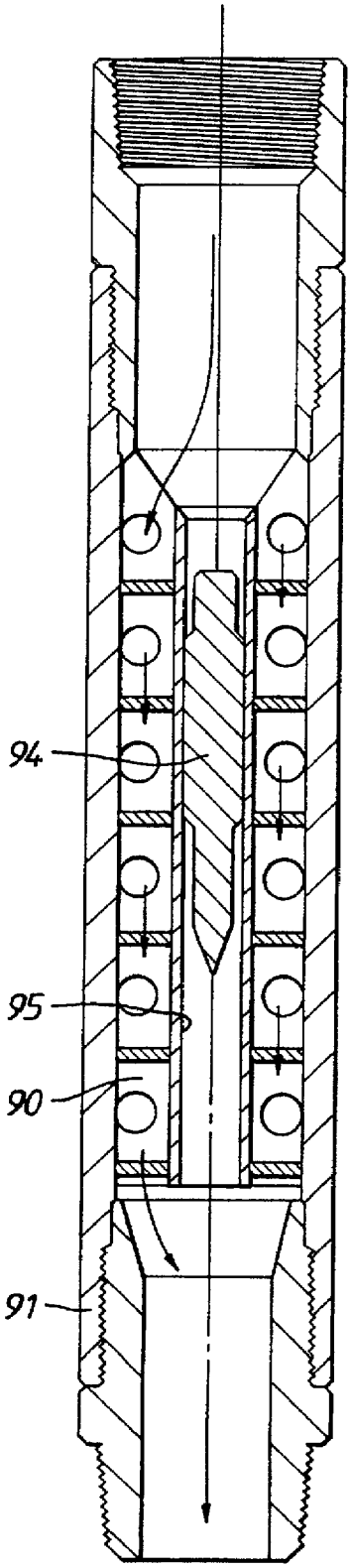
FIG. 15 is a similar view to FIG. 14 but showing the by-pass passage blocked by a wireline deployed plug to force flow through the valve members.

The second form of the device shown in FIGS. 9, 10 and 11 and the third form of the device shown in FIGS. 12 and 13 can be formed from members of two different kinds. The first form of the members is shown in FIGS. 5 and 6 and the second form of the members is shown in FIGS. 7 and 8.

Figure 5:
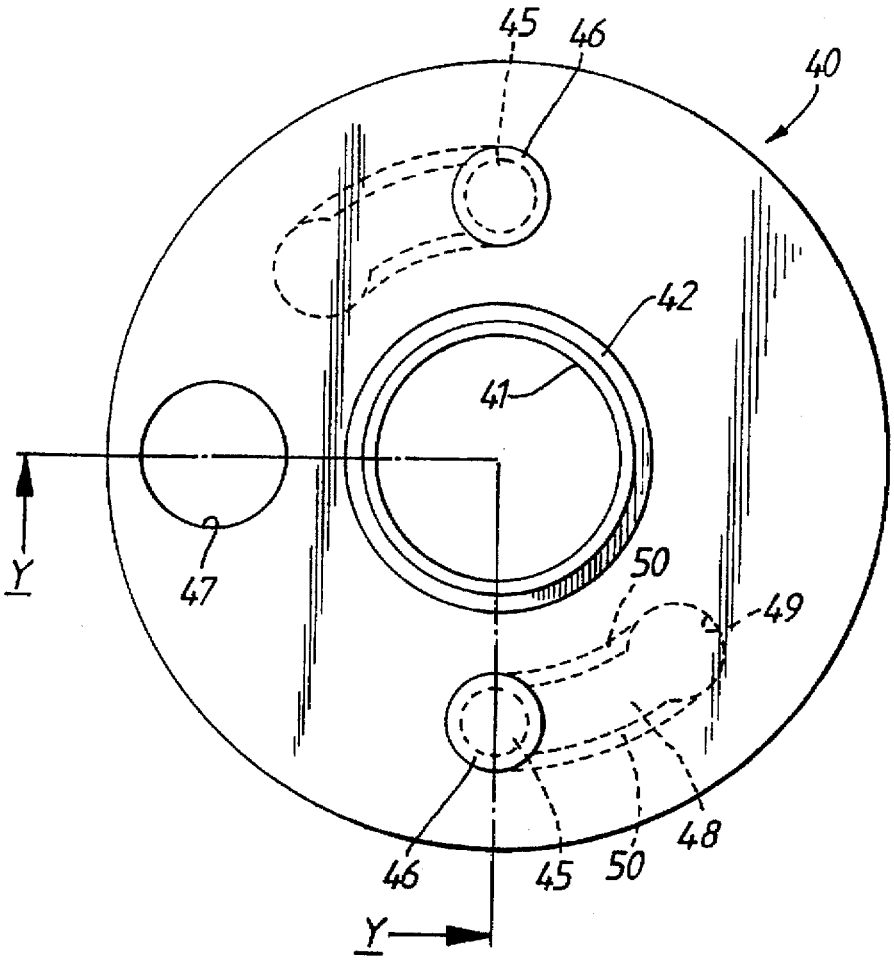
FIG. 5 is a plan view from above of a member which, when arranged in a stack with other similar members, forms a second form of device preventing U-tubing in the flow of drilling mud/cement slurry in oil well casings.
Figure 6:
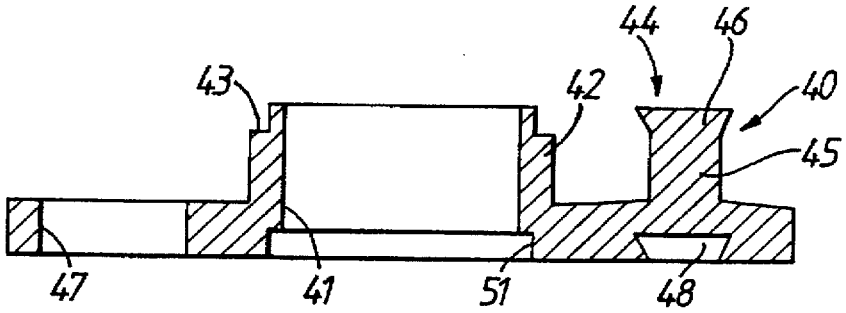
FIG. 6 is a section on the line Y—Y of FIG. 5.

Referring first to FIGS. 5 and 6, the first form of member comprises a plate 40 formed with a central aperture 41 surrounded by a projecting tube 42. The flange has an outwardly directed rebate 43 at its free end.

Two pegs 44 project from the same side of the member 40 as the tube 42 on diametrically opposite sides of the flange. Each peg has a generally cylindrical body 45 and an outwardly tapering frusto-conical head 46.

An orifice 47 extends through the member 40 to one side of the aperture 41.

The other surface of the member 40 is provided with a slot 48 commencing beneath an associated peg and extending arcuately around the member for about 45°. Each slot 48 has a circular entrance 49 which is generally the same diameter as the head 46 of the peg 44. Two flanges 50 extend along the inner and outer arcuate edges of each slot 48 at the surface of the member so that, as best seen in FIG. 6, the slot 48 is of generally frusto-conical cross-section in radial planes.

This allows successive members 40 to be interconnected in a stack. This is achieved by inserting the heads 46 of the pegs 44 of one member 40 into the entrances 49 of the slots 48 of a second member 40. The two members are then rotated relative to one another so that the heads 46 slide along the slots 48, being guided by the flanges 50, until the pegs 44 of one member 40 are located beneath the pegs 44 of the other member 40.

At the same time, the rebate 43 on the tube 42 of one member 40 engages in a mating rebate 51 in the aperture 41 of the other member 40 thus forming a continuous passage through the two members 40.

The second form of the device shown in FIGS. 7 and 8 has a member 60 formed with an aperture 41, a tube 42, a rebate 43, an orifice 47 and mating rebate 51 of the same form as the corresponding parts in the member 40 described above with reference to FIGS. 5 and 6. These parts will, therefore, not be described further.

In this second form of member 60, however, two pegs 61 are provided on diametrically opposite sides of the aperture 41. Each peg has a cylindrical body 62 with a thin flange 63 extending around the free end of the body. The flange is formed with an external annular bead 64.

On the opposite side of each member 60, in axial alignment with the axis of the peg 61, are two circular depressions 65. Each depression 65 is provided with an annular recess 66.

The rebate 43 at the end of the flange 42 of one member 60 can thus be inserted into the mating rebate 51 in a second member 60. At the same time, the flange 63 on one member 60 can be inserted into the depression 65 in the other member 60 with the two parts fitting together with a snap fit provided by the beads 64 and the recess 66.

The second and third forms of the device, which can be formed by members 40 or members 60, will now be described with reference to FIGS. 9 to 11 and 12 and 13 respectively. In the description of these embodiments, the members will be given the general reference 70 but it will be understood that this can refer either to a member 40 of the kind described above with reference to FIGS. 5 and 6 or a member 60 as described above with reference to FIGS. 7 and 8.

In the second device shown in FIGS. 9, 10 and 11, a stack of members 70 are interconnected as described above. Alternate members 70 have their orifices 47 offset on alternately opposite sides of the by-pass passage 71 formed by the interconnected tubes 42. The stack of members 70 are supported by a catcher sub 29 similar to that described above with reference to FIGS. 1 to 4.

A valve 72 is provided between the sixth and seventh members 70. The valve 72 is constructed generally similarly to a member 70 with the difference that the tube 42 is provided with four equi-angularly spaced radially extending holes 73. Since the tube 42 must be made longer in order to accommodate the hole 73, the length of the pegs (44 or 61) must be similarly increased.

A sleeve 75 extends through the portion of the passage 71 defined by the first six members 70 has its lower end closing the holes 73 in the valve 74. The lower end of the sleeve 75 is provided with four equi-angularly spaced radially extending holes 76 which are circumferentially aligned but axially out of register with the holes 73 in the valve 72.

The upper end of the sleeve 75 is connected to inner ends of radially extending legs 77 whose outer ends are connected to an annular ring 78 projecting upstream along the interior surface of the associated casing section 79.

An inlet assembly 80 is contained within the sleeve 78 and comprises an apertured cup 81 which opens in an upstream direction and which is provided with feet 90 which pass between the legs 77 to support the cup 81 on the stack of members 70. The centre of the cup 81 holds a seat 82 which is connected to the cup 81 by a shear pin 83. The upper end of the sleeve 75 is received in an annular gap 84 between the cup 81 and the seat 82 but is movable relative to both parts.

In use, the casing section 79 containing the device is inserted into the casing string with the device towards the lower end of the casing string. During normal drilling, the drilling mud passes through the by-pass passage 71 (although there may also be some mud passing through the passage provided between and through the orifices 47). When cement slurry is to be pumped, however, a ball 85 is dropped down the casing and is caught by the cup 85 and guided on to the seat 82 where it closes the by-pass passage. Cement slurry is then pumped down the casing string, with a wiper plug 86 (seen in FIG. 11) being pushed through the casing string at the front of the volume of cement slurry.

The drilling mud displaced by the cement slurry passes through the apertures in the cup 81 and through the passage defined through and between the orifices 47.

The cement slurry can move out of the control of the well head pump before the cement slurry reaches the device. In this case, there will be a sudden increase in pressure in the drilling mud passing through the device. The size and number of the orifices 47 is such that they act as a throttling valve to prevent such a pressure rise being transmitted across the device into the drilling mud between the casing string and the well. In this way, U-tubing is controlled in this situation.

Such a throttling valve configuration is not, however, suitable for controlling the pressure rises liable to cause U-tubing when the device is filled with cement slurry, because cement slurry is more viscous and dense than drilling mud. This is dealt with in the following way by the device described above with reference to FIGS. 9 to 11.

The arrival of cement slurry at the device will be accompanied by the arrival of the wiper plug 86. As it reaches the device, the wiper plug 86 will engage the projecting end of the ring 78 and will remove this ring downwardly relative to the cup 81 and the member 70. This in turn will cause downward movement of the sleeve 75 until the holes 76 are aligned with the holes 73 in the valve 72. As a result, cement slurry entering the members 70 will pass only through the portion of the passage 71 formed by the first six members 70 and will then exit the holes 73/76 into the by-pass passage 71.

The number of orifices 47 traversed by the cement slurry is chosen to provide a throttling valve which controls the pressure rises in cement slurry associated with U-tubing.

In the event of plugging of the device, whether by drilling mud or cement slurry, the substantial pressure rise associated with such plugging will force the ball 85 down on the seat 81 and shear the frangible pin 83. This will allow the ball 85 to pass through the by-pass passage 71 and so allow drilling mud/cement slurry also to pass through the by-pass passage 71 so by-passing the plugging.

Referring now to FIGS. 12 and 13, the third device is generally similar to that described above with reference to FIGS. 9 to 11 and so parts common to the two devices will be given the same reference numerals and will not be described in detail.

In this third device, the stack of members 70 is as described above with reference to FIGS. 9 to 11 with a valve 72, sleeve 75, cup 81 and associated parts, as described above with reference to FIGS. 9 to 11. However, the centre of the cup 81 is closed by a plug 87 connected to the cup by a frangible pin 88.

In addition, the whole device is contained within a wiper plug 89.

The device is inserted in the upper end of the casing string when the casing string is in place and is pumped into position with drilling mud, the throttling effect of the orifices 47 providing a back pressure which causes such movement. This movement continues until the device engages the catcher sub 29 when the device is positioned in the casing string.

As the cement slurry is pumped, the device operates as described above with reference to FIGS. 9 to 11.

Initially, drilling mud passes through the whole stack of members 70 which provide control against U-tubing as described above. As the wiper plug 86 reaches the device, the ring 78 is moved downwardly to open the valve 72 thus providing control of U-tubing for the cement slurry. If plugging occurs, the pin 88 shears and the plug 87 passes through the by-pass passage 21 to the catcher sub 29.

It will be appreciated that a large number of variations can be made in the devices described above. The throttling effect need not be provided by orifices of the kind and arrangement described above, they could be provided by convergent/divergent passages or any other suitable means. The devices need not be formed from a stack of similar members, they could be formed as a single member.

In addition, the number and size of the orifices can be adjusted as necessary to provide a particular throttling effect. The throttling effect need not be applied to drilling mud/cement slurries, it could be applied to any fluids encountered in oil wells.

Where a valve is provided to alter the throttling effect to match it to a fluid of higher viscosity, the valve need not be actuated by a wiper plug, it could be actuated by the increased differential pressure generated across the device as the higher viscosity fluid commences its passage through the device.

Figure 16:
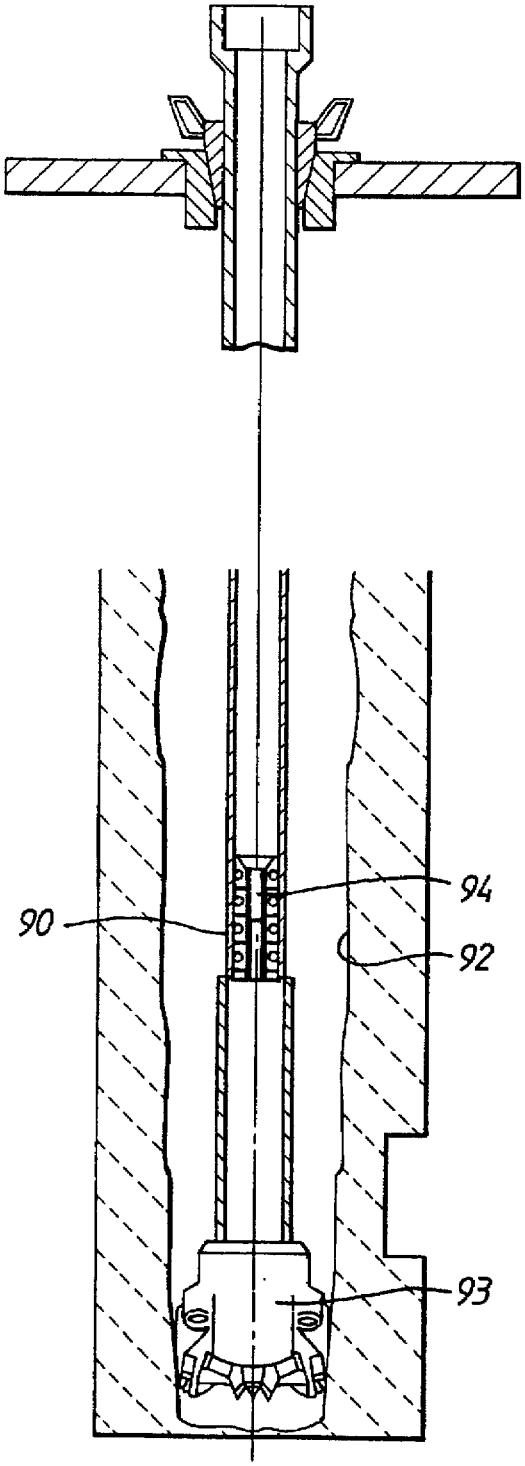
FIG. 16 is a schematic view of a well showing a rig floor and an end section of drill pipe carrying a drill bit and with the device of FIG. 14 installed in the drill pipe upstream of the drill bit and with the wireline deployed plug positioned as shown in FIG. 15 to locate a washed-out connection.
Figure 17:
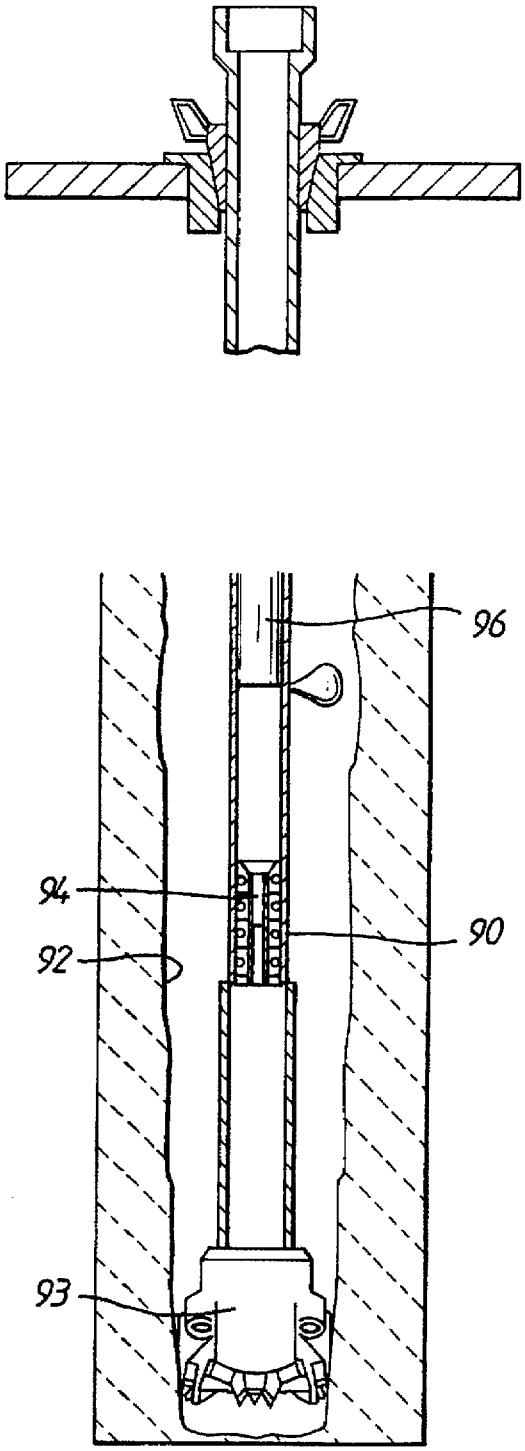
FIG. 17 is a similar view to FIG. 16 and showing a viscous fluid pumped down the drill pipe to locate the washed-out connection.

Referring now to FIGS. 14 to 19, a device 90 of the kind described above with reference to FIGS. 1 to 4 can be used to locate a washed-out connection in a drill pipe 91 (best seen in FIGS. 16 and 17). A "washed-out connection" occurs when the drill pipe 91 develops a leak so that drilling mud or other fluid being pumped through the drill pipe 91 passes through the drill pipe 91 into the annular space between the bore hole 92 and the outer surface of the drill pipe 91 (see FIG. 17). This can be caused by a failure of a threaded connection or other seal.

In order to locate the washed-out connection, it has previously been necessary to extract the drill pipe 91 and examine each pipe connection closely as they are withdrawn. This is very time consuming because the drill pipe may be many thousands of meters long.

In order to allow such a washout to be located, the device 90 is located in the drill pipe 91 just upstream of the bottom hole assembly 93, as seen in FIG. 17. When a washout occurs, a wire line plug 94 or bomb or pump-down plug is lowered down the drill pipe 91 and enters the by-pass passage 95 to block the passage. As a result, fluid passed down the drill pipe 91 is forced through the device 90.

Figure 18:
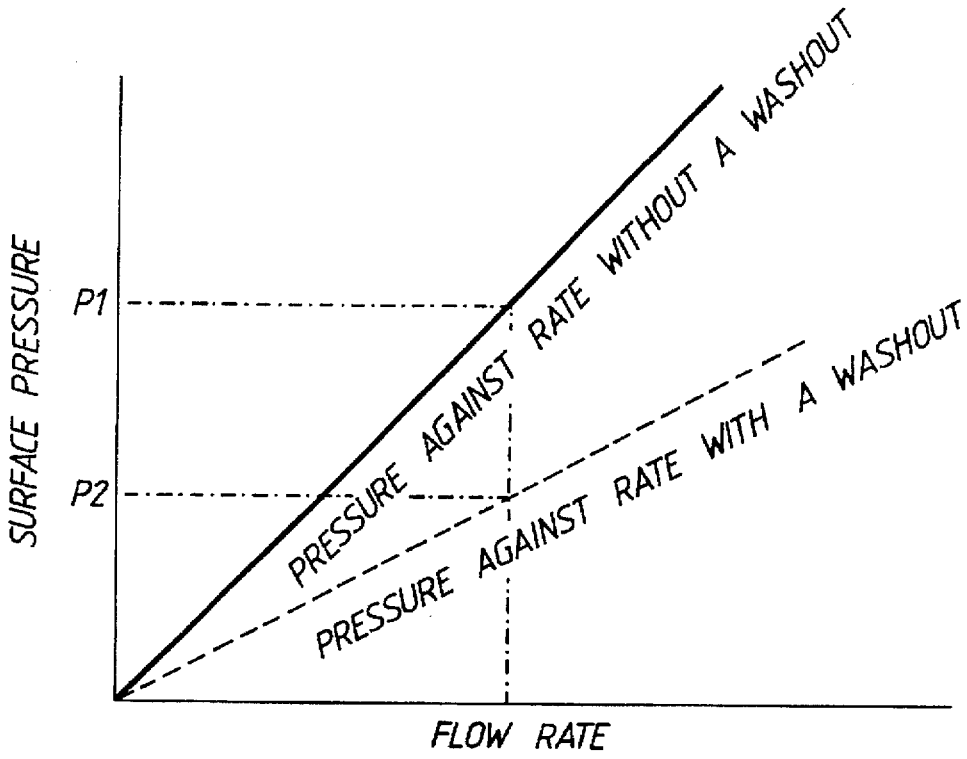
FIG. 18 is a graph plotting flow rate of a fluid pumped through the drill pipe against the pressure of the fluid at the surface and showing a plot when no washout is present and a plot when a washout is present.
Figure 19:
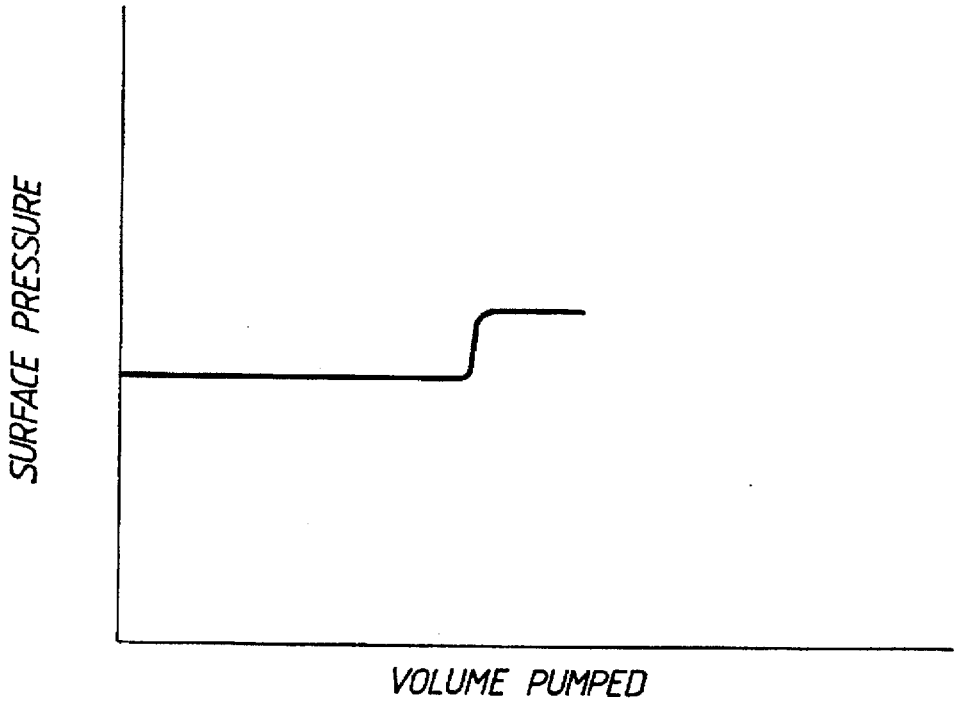
FIG. 19 is a graph plotting the volume of viscous fluid pumped down the casing against the pressure of the viscous fluid as measured at the surface and showing the increase in pressure when the volume is sufficient to reach the washed-out connection.

With reference to FIGS. 17, 18 and 19, this can be used to locate the washed-out connection in the following way.

As shown in FIG. 18, when no washout is present, the flow rate of a fluid such as drilling mud down the drill pipe 91 is directly proportional to the surface pressure. When a washout is present, the flow rate is still proportional to the surface pressure but with a much lesser slope. This is because fluid is being lost through the washed-out connection and so the fluid is being pumped against a lesser back pressure.

By watching for changes in the ratio between flow rate and surface pressure, the presence of a washed-out connection can be determined. When such a washed-out connection is determined, the plug 94 is lowered into the drill pipe 91 until the passage 95 is closed. A fluid which is much more viscous than the fluid in the drill pipe 91 is then pumped down the drill pipe 91 in known volume.

The viscous fluid 96 displaces in front of it the fluid already in the drill pipe 91, which passes through the device 90 and out of the washed-out connection. At the surface, a plot is made of the volume of viscous fluid 96 pumped against the surface pressure (see FIG. 19). When the viscous fluid 96 reaches the washed-out connection, there is a step rise in the surface pressure because the fluid in front of the viscous fluid already in the drill pipe 91 can no longer exit the washed-out connection so that the fluid is being pumped almost wholly against the back pressure provided by the throttling effect of the device 90, as described above with reference to FIGS. 1 to 4. The magnitude of the step rise depends on the differences in the viscosity and the density of the fluids.

This is observed at the surface. Knowing the diameter of the drill pipe 91, and the volume of viscous fluid 96 pumped down the drill pipe 91, a figure accurate to 2 or 3 connections can be derived for the location of the washed-out connection. It is then possible to remove the drill pipe 91 very rapidly from the bore hole 92 and observe only the few connections where the washout may be located. A repair can then be made and the drill pipe 91 returned to the bore hole 92.

The plug 94 can then be removed and drilling mud or other fluid fed normally through the by-pass passage 95 without introducing any significant back-pressure resistance into the drill pipe.

It will be appreciated that the throttling effect of any of the devices described above with reference to FIGS. 1 to 13 may be utilized to locate accurately the "front" between fluids of differing viscosities being pumped down a casing string. For example, using the device described above with reference to FIGS. 1 to 4 and in the configuration shown in FIGS. 14 to 19 (but in a casing string rather than a drill pipe), when the passage 95 is closed by the wire-line plug 94, there will be a sharp change in pumping pressure when the "front" between the fluids of differing viscosities reaches the device 90. If the upstream fluid has a lower viscosity and the downstream fluid a higher viscosity, the change in pressure will be a sharp decrease. If the upstream fluid is of greater viscosity and the downstream fluid of lesser viscosity, then there will be a sharp increase. This can allow an operator to determine exactly when different fluids reach the device 90 and can be useful in mapping the progress of fluids through the system.

We claim:

1. An oil well drilling system comprising:

an oil well tube extending from a well head into an oil well, the oil well tube having an end remote from said well head, an interior surface provided on the oil well tube, a device within the oil well tube located towards said remote end of the oil well tube, said device comprising:

an outer surface in engagement with said interior surface of the oil well tube, means defining an inlet to the device, means defining an outlet to the device, a plurality of generally plate-shaped contacting members arranged in a stack to define a flow path for fluid through the device between the inlet means and the outlet means with an orifice in each said plate and a spacer on each member holding said member in spaced relationship relative to an adjacent member to form a portion of said flow path and to space successive orifices angularly from one another, wherein said orifices form a throttling valve for restricting the flow of fluid therethrough, each said portion of said flow path forming a downstream portion of the flow path for an orifice and an upstream portion of the flow path for the next succeeding orifice in a downstream direction, each orifice being of smaller cross-sectional area than the portions of the flow path upstream and downstream thereof.

2. A system according to claim 1 wherein the spacer comprises at least two spaced pegs on each plate and a corresponding number of receivers for receiving the pegs of an adjacent plate.

3. A system according to claim 2 wherein each peg includes a head, each receiver comprising an arcuately extending slot within the associated plate, each slot terminating in an entrance so that the head of a peg of an adjacent plate can be inserted in said entrance and then moved along the slot, by relative rotation between said plates, to form said stack.

4. A system according to claim 2 wherein each receiver comprises a circular depression having an annular rebate extending therearound, each peg including at the end thereof an annular bead so that the end of each peg is a snap-fit in a depression to form said stack.

5. A system according to claim 1 wherein the stack of members is held by a wiper plug for insertion in a tube to allow the stack and the wiper plug to travel along the tube.

6. An oil well cementing system comprising:

a supply of cement located outside the oil well, a well head;

an oil well tube extending from said well head into an oil well, the oil well tube having an end remote from said well head;

an interior surface provided on the oil well tube, a pump for pumping cement from the supply to the oil well tube, a U-tubing prevention device within the oil well tube located towards said remote end of the oil well tube, said device comprising:

an outer surface in engagement with said interior surface of the oil well tube, means defining an inlet to the device, means defining an outlet to the device, means defining a flow path for fluid through the device between the inlet means and the outlet means, a throttling valve for at least restricting the flow of fluid therethrough and located in the flow path means between the inlet means and the outlet means, wherein the throttling valve comprises a series of orifices, each orifice of smaller cross-sectional area than the cross-section of the flow path means upstream and downstream of the orifice, said series of orifices arranged successively along said flow path means, each orifice having a downstream section of the flow path means of larger cross-section associated therewith, said section forming an upstream section of the flow path means of larger cross-section for the next succeeding orifice in a downstream direction, the orifices allowing the flow of cement therethrough under the control of the pump, but at least restricting the flow of cement therethrough on the onset of U-tubing.

7. A system according to claim 6 wherein the flow path means is formed by a plurality of contacting members arranged in a stack, each member including at least one orifice.

8. A system according to claim 6 wherein the flow path means is formed by a plurality of contacting members arranged in a stack, each member including at least one orifice, and wherein each extend includes axially spaced end plates between which extend a plurality of radially extending angularly spaced plates, each, except one plate, including an orifice and the spaces between the radial plates defining said upstream and downstream sections of the flow path means.

9. An oil well drilling system comprising:

an oil well tube extending from a well head into an oil well, the oil well tube having an end remote from said well head, an interior surface provided on the oil well tube, a device within the oil well tube located towards said remote end of the oil well tube, said device comprising:

an outer surface in engagement with said interior surface of the oil well tube, means defining an inlet to the device, means defining an outlet to the device, means defining a flow path for fluid through the device between the inlet means and the outlet means, a throttling valve for at least restricting the flow of fluid therethrough and located in the flow path means between the inlet means and the outlet means, wherein the throttling valve comprises a series of orifices, each orifice of smaller cross-sectional area than the cross-section of the flow path means upstream and downstream of the orifice, said series of orifices arranged successively along said flow path means, each orifice having a downstream section of the flow path means of larger cross-section associated therewith, said section forming an upstream section of the flow path means of larger cross-section for the next succeeding orifice in a downstream direction, wherein the flow path means is formed by a plurality of contacting members arranged in a stack, each member including at least one orifice, and wherein each member includes axially spaced end plates between which extend a plurality of radially extending angularly spaced plates, each, except one plate, including an orifice and the spaces between the radial plates defining said upstream and downstream sections of the flow path means.

10. A system according to claim 9 wherein one end plate is provided with inlet means to one side of the non-orificed radial plate, with the other end plate being provided with outlet means to the other side of the non-orificed radial plate.

* * * * *